United States Patent [19]

Hoffman et al.

[11] Patent Number: 4,724,642

[45] Date of Patent: Feb. 16, 1988

[54] CONSTRUCTION DEVICE FOR CONNECTING BUILDING ELEMENTS

[76] Inventors: Paul Hoffman; Sam H. Bright, both of P.O. Box 2628, Eugene, Oreg. 97402

[21] Appl. No.: 926,291

[22] Filed: Nov. 3, 1986

[51] Int. Cl.[4] ..... E02D 27/42

[52] U.S. Cl. ..... 52/298; 52/169.13; 52/297; 403/170; 403/172; 403/174; 403/178

[58] Field of Search ..... 52/169.9, 169.13, 297, 52/298, 295, 293; 403/170, 172, 174, 178

[56] References Cited

U.S. PATENT DOCUMENTS

| | | | |
|---|---|---|---|
| 357,217 | 2/1887 | McCallip | 52/297 |
| 364,427 | 6/1887 | McCallip | 52/297 |
| 469,638 | 2/1892 | Chase | 52/721 X |
| 1,162,164 | 11/1915 | Honens | 52/295 X |
| 2,129,211 | 9/1938 | Hickl . | |
| 3,505,764 | 4/1970 | Gutierrez | 52/263 X |
| 4,328,651 | 5/1982 | Gutierrez | 52/169.9 X |
| 4,614,070 | 9/1986 | Idland | 52/296 |

FOREIGN PATENT DOCUMENTS

| | | | |
|---|---|---|---|
| 881835 | 9/1971 | Canada | 52/263 |
| 2902322 | 7/1980 | Fed. Rep. of Germany | 52/79.9 |
| DE3014523 | 10/1981 | Fed. Rep. of Germany . | |
| 946337 | 12/1948 | France . | |
| 822738 | 10/1959 | United Kingdom | 52/263 |
| 705086 | 12/1979 | U.S.S.R. | 52/297 |

*Primary Examiner*—Alfred C. Perham

*Attorney, Agent, or Firm*—Eugene M. Eckelman

[57] ABSTRACT

A body member comprising either a concrete block or molded or stamped product, includes upwardly opening recesses forming an anchor seat for building elements. The recesses may extend fully from side to side and also open out the sides so that building elements can be laid horizontally therein or fully across the body member. The recesses also include a central socket for receiving an upright pillar. Embodiments of the invention may include depending foot members. Embodiments of the inventions also include structure for fastening building elements to the body member. A further embodiment employs depending projections at outer portions thereof which frictionally fit on top of a base block and stabilize the body member against lateral movement.

4 Claims, 15 Drawing Figures

CONSTRUCTION DEVICE FOR CONNECTING BUILDING ELEMENTS

BACKGROUND OF THE INVENTION

This invention relates to new and useful improvements in construction devices and is particularly concerned with a construction device of the type which is adapted to support and/or connect a building element relative to a base or other supporting surface.

Various types of devices have heretofore been used for supporting and/or connecting building elements, such as horizontal beams, joists, stringers, posts and pillars, to a base slab, footing, foundation or block member. For example, such devices comprise anchor studs or other supports or devices that are embedded in the concrete or otherwise secured thereto. Such devices are used to provide vertical and lateral connection of building elements to a base or to other elements.

SUMMARY OF THE INVENTION

According to the present invention and forming a primary objective thereof, a construction device is provided which by its structural arrangement and unique design amounts to an improvement over prior devices in that it is very versatile for providing a support and/or connection arrangement between a base and a building element.

A more particular object of the invention is to provide a construction device of the type described having a novel arrangement of recesses, walls, and sockets for receiving horizontal beams and the like, and also capable of receiving vertical pillars or posts, all in a variety of selected support connections not heretofore available.

Another object of the invention is to provide an embodiment of the invention comprising a plurality of integrated wall portions disposed in a zig zag pattern and forming one or more full width recesses for receiving horizontal beams and the like and also forming a rectangular central socket for receiving a vertical pillar or post.

It is another object of such embodiment and design to provide means for attaching the construction device to horizontal beams and the like and vertical pillars and also to a base.

In carrying out the above objectives, the construction device of the invention comprises a body member having a lower surface which serves as a support on a base such as a slab, footing, pier block etc. The body member has one or more recess means arranged to receive horizontal beams and the like. The body member also has a central socket for receiving a vertical pillar or post. In one embodiment of invention, recess means are disposed on each of four sides of the body member at 90 degrees apart and communicate with the central socket and the exterior, the pairs of recesses opposite from each other being aligned whereby construction beams or the like can be laid therein in edge and/or end relation. Also, in such embodiment, the construction device has fastener-receiving means therein for attaching a beam or beams and a pillar together and also for attaching the assembly to a base. In another embodiment, side edges of the body member at the recess openings have downturned projections shaped on a rear portion thereof to frictionally fit on top of pier blocks for anchoring the body member against lateral shifting.

The invention will be better understood and additional objects and advantages will become apparent from the following description taken in connection with the accompanying drawings.

DETAILED DESCRIPTION OF PREFERRED EMBODIMENTS

Figure 1:
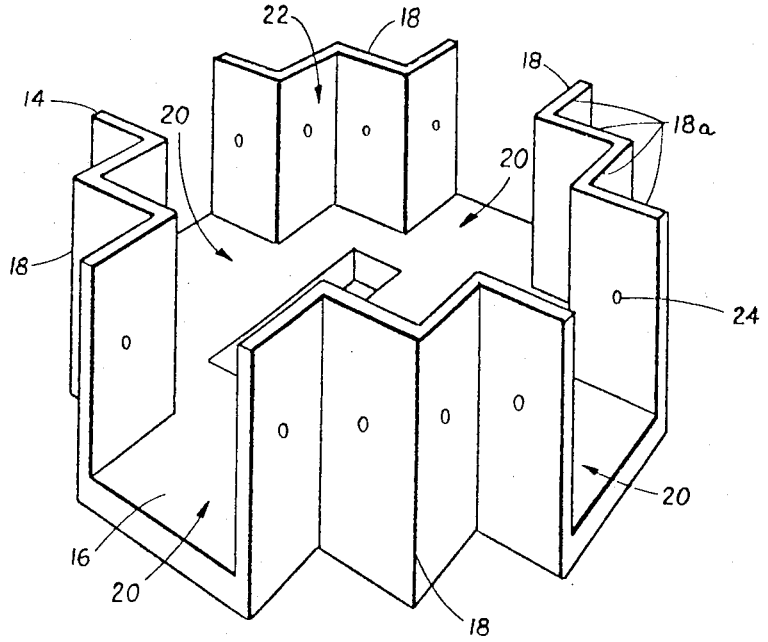
FIG. 1 is a top perspective view of a construction device embodying features of a first embodiment of the invention.

With reference first to FIGS. 5 through 8, the numeral 10 represents a base or pier block of conventional structure which is commonly used to support decks, carports, etc. This block is generally constructed of concrete and assumes different shapes. In most cases. the block is tapered to a lesser dimension toward the top. The top and bottom surfaces 12 are flat.

According to the present invention, a first embodiment of the invention comprises a construction device 14, FIGS. 1–8, which may be molded, stamped, or otherwise formed from a tough plastic or metal. The body member of the device 14 includes a flat bottom wall 16 and four identically shaped or symmetrical upright quarter sections 18. Each of the sections 18 comprises four zig zag panels **18*a* joined integrally at right angles. These symmetrical quarter sections are shaped to form a recess or opening 20 on each side, with oppositely located recesses being laterally aligned. Also, with this quarter section construction, a square central socket 22 is formed. Laterally aligned recesses 20** provide a full width slot open at the sides.

Figure 2:
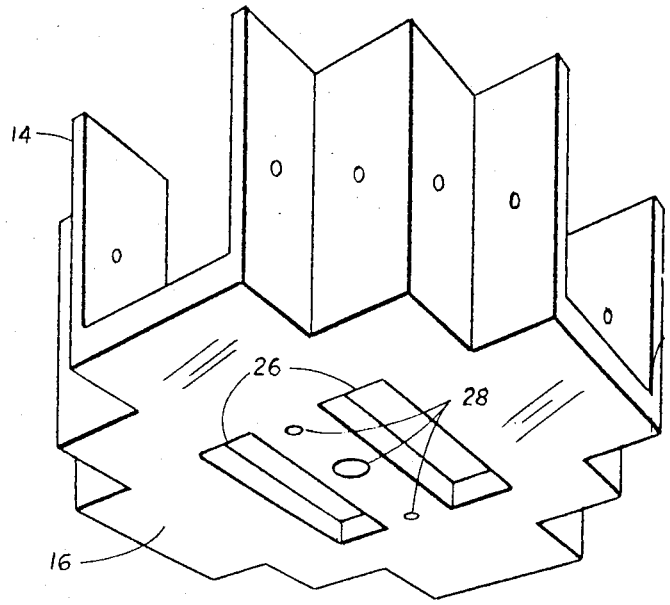
FIG. 2 is a bottom perspective view of the embodiment of FIG. 1.

Each of the panel sections **18*a* has one or more apertures 24 therein provided to receive fasteners, to be seen hereinafter, for securement of building elements to the device 14. As seen in FIG. 2, cutouts 26 are provided in the bottom wall 16 for reducing the weight of the member as well as for conserving material. Also, apertures 28 are provided in the wall 16 for secured attachment of the member 14 to a base, such as to a block 10**, concrete slab, or other support means.

Figure 5:
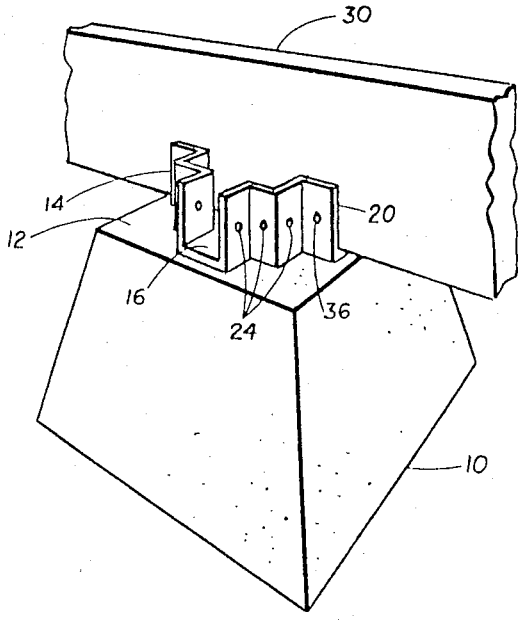
FIGS. 5, 6, 7 and 8 perspective views showing various applications of the embodiment of FIG. 1 for association with structural building elements.
Figure 6:
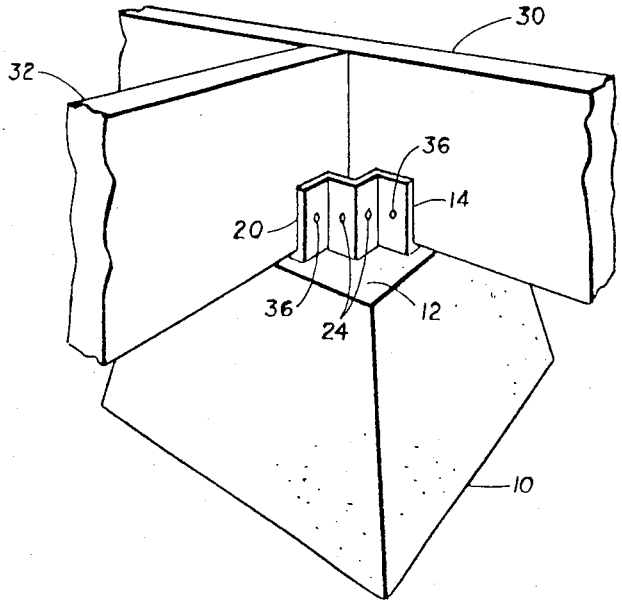
Figure 7:
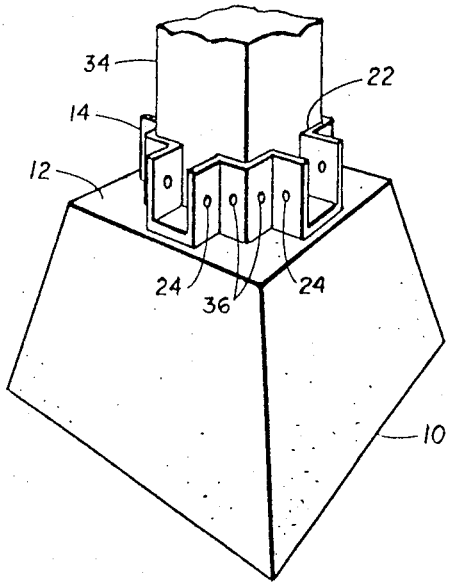
Figure 8:
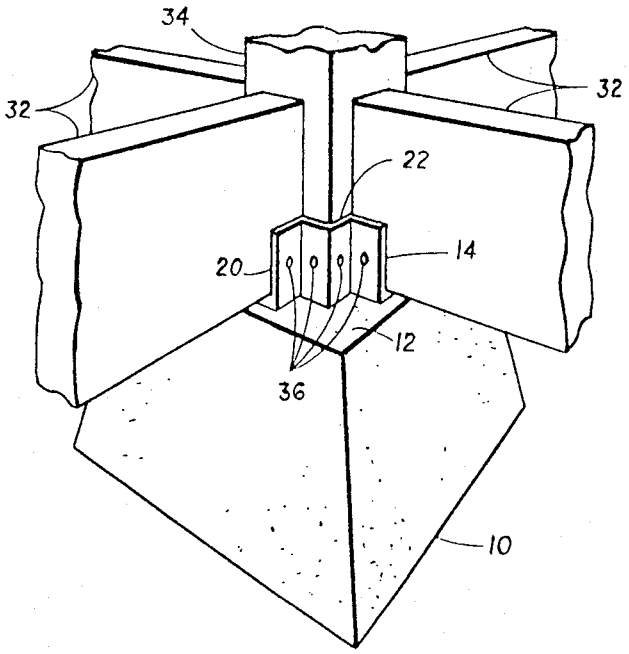

FIGS. 5, 6, 7 and 8 show various applications of the construction device 14 with building elements such as beams and pillars. FIG. 5 for example shows a floor beam or joist 30 seated edgewise on the bottom wall 16 and extending fully through the device and out both side recesses 20. FIG. 6 shows a beam 30 similarly supported as in FIG. 5 but also showing a right angle beam 32 extending through a 90 degree side recess 20 and abutted against the beam 30. FIG. 7 shows a vertical pillar 34 supported on the device 14 and fitted in the central socket 22. FIG. 8 shows a pillar 34 similarly fitted in the socket 22 as in FIG. 7 but also showing side beams 32 extending in from all four of the side recesses. These members may simply be fitted in the respective recesses 20 or socket 22 but in most cases secured attachment to the member 14 is accomplished by fasteners 36 extending through the apertures 24. Also, device 14 can first be secured to the base member by fasteners extending through the apertures 28.

Figure 3:
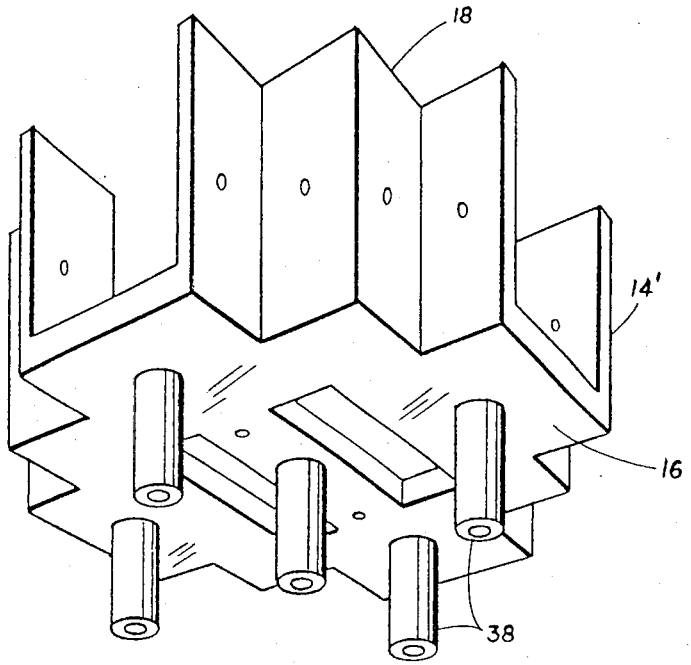
FIGS. 3 and 4 are bottom perspective views of embodiments having support and securing means for the body member relative to a base.
Figure 4:
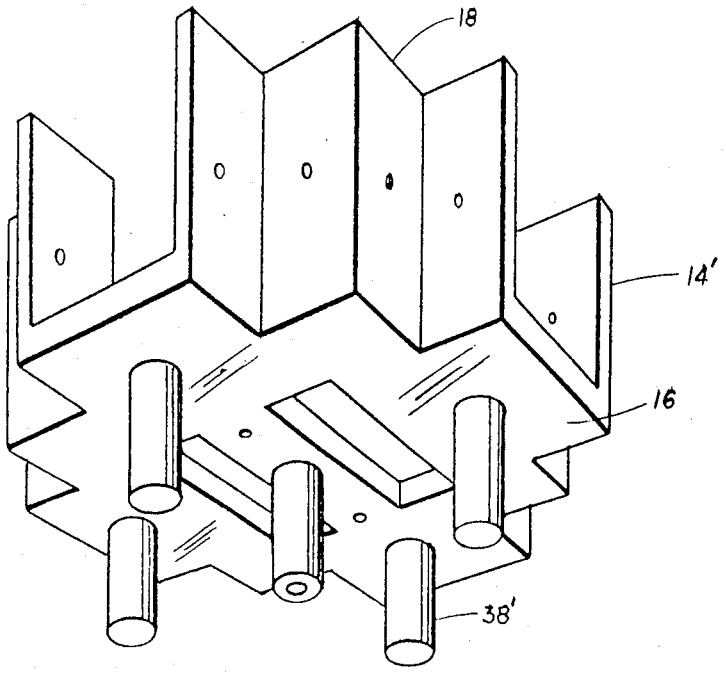

FIG. 3 is a bottom perspective view of a construction device 14' having a bottom wall 16 and side walls 18 in an arrangement similar to that shown in FIGS. 1 and 2. This structure, however, is formed, such as by integral molding, with a plurality of depending foot members 38. Four of such foot members are shown, as well as a central foot member, but any number of such foot members may be provided. In the FIG. 3 embodiment, the foot members 38 are hollow whereby long fasteners can be inserted down from the top through the wall 16 and into a base for secured attachment of the construction device 14' to the base. FIG. 4 shows a structure similar to FIG. 3 except that the outer foot members 38' are solid and not hollow. This embodiment may be employed in circumstances where it is not necessary to use vertical fasteners around an outer portion of the member.

FIGS. 9–12 illustrate an embodiment of the invention employing means for anchoring the body member against lateral shifting. In this embodiment, the body member 14" is the same as that shown in FIG. 1 as to quarter panel sections 18*a* and their formation of aligned recesses 20 and central socket 22. To accomplish the lateral anchoring feature the outermost panel section 18a of each quarter section has a depending projection or lip 40 defined by a bottom wall portion 42 integral with side extensions 44 and a rear wall portion 46. Rear wall portion 46 preferably angles outwardly toward the bottom whereby to coincide with the angle of the side surfaces of a pier block 10 of the type shown in FIGS. 5–8. Wall portion 46 can extend at the desired angle, so as to have flush engagement with the pier block sides.

Figure 9:
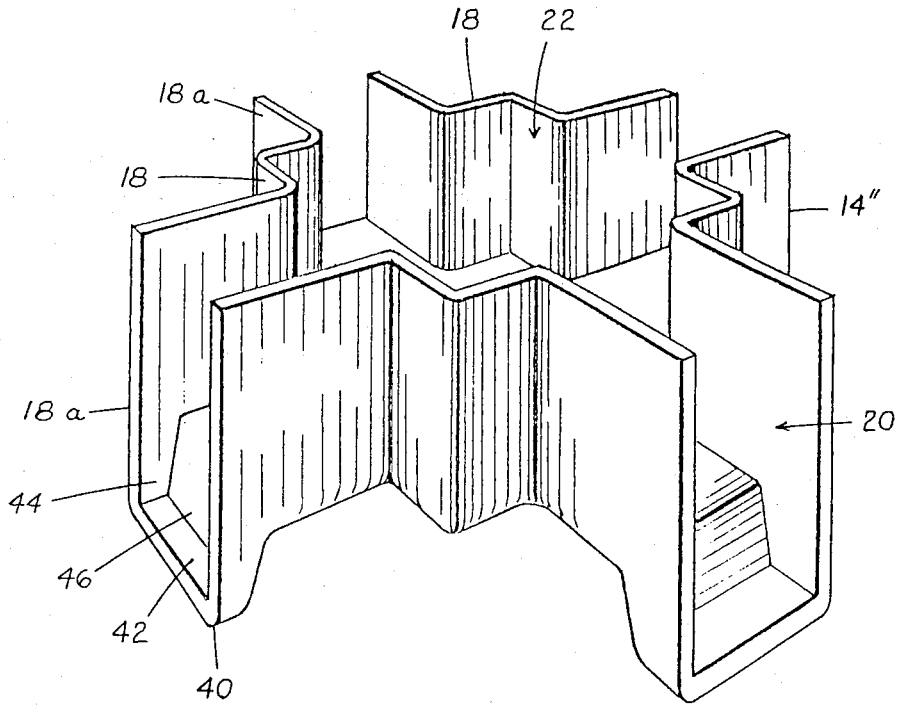
FIG. 9 is a top perspective view of another embodiment of this embodiment including lateral stabilizing means on the body member.
Figure 10:
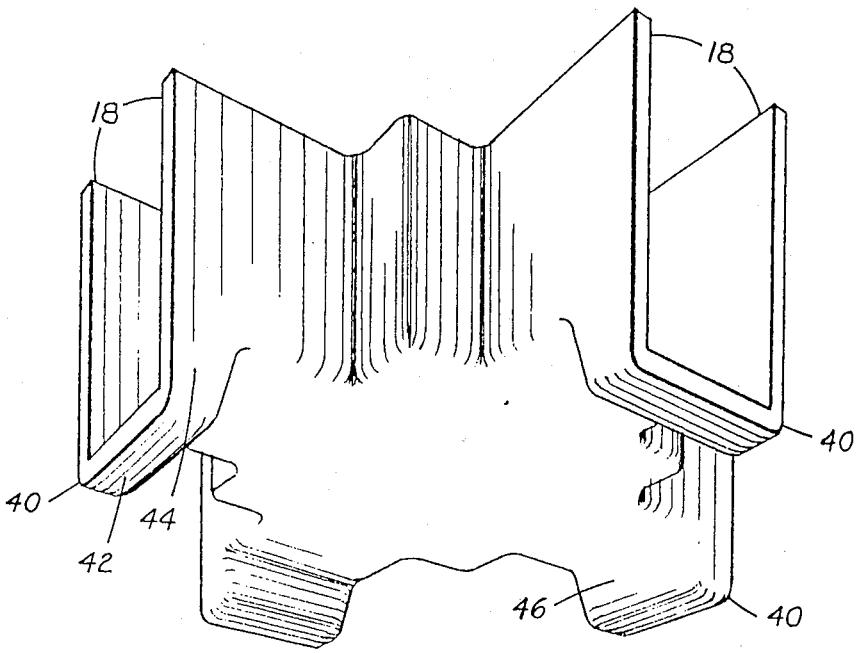
FIG. 10 is a bottom perspective view of the embodiment of FIG. 9.
Figure 11:
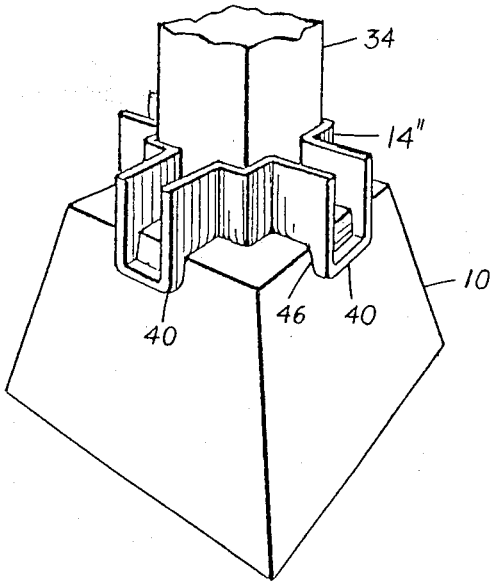
FIGS. 11 and 12 are perspective views showing various applications of the embodiment of FIG. 9.
Figure 12:
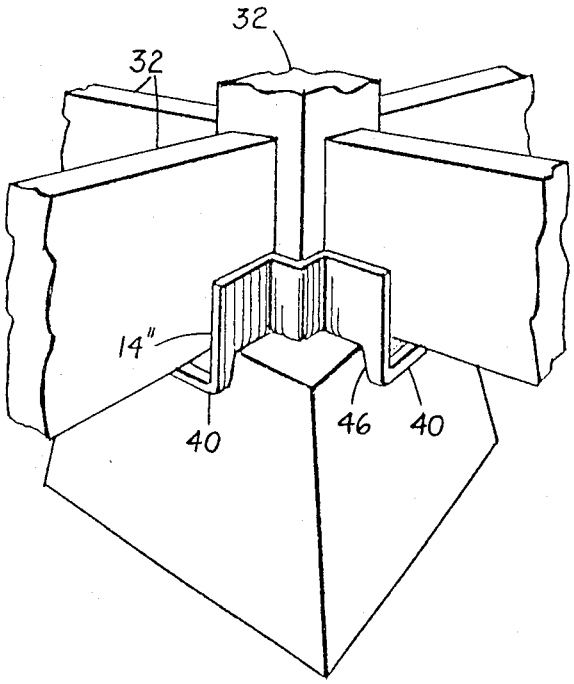

FIGS. 11 and 12 show application of the device 14" of FIG. 9 to a pier block. In such arrangement, the device and the building elements therein are anchored or locked against lateral shifting. Fasteners extending through the bottom wall of the device are not necessary, although such fasteners can be used if desired. The cross dimension of the device between wall portions 14" can be preselected according to the size of the pier block so that a snug or frictional fit is provided.

Figure 13:
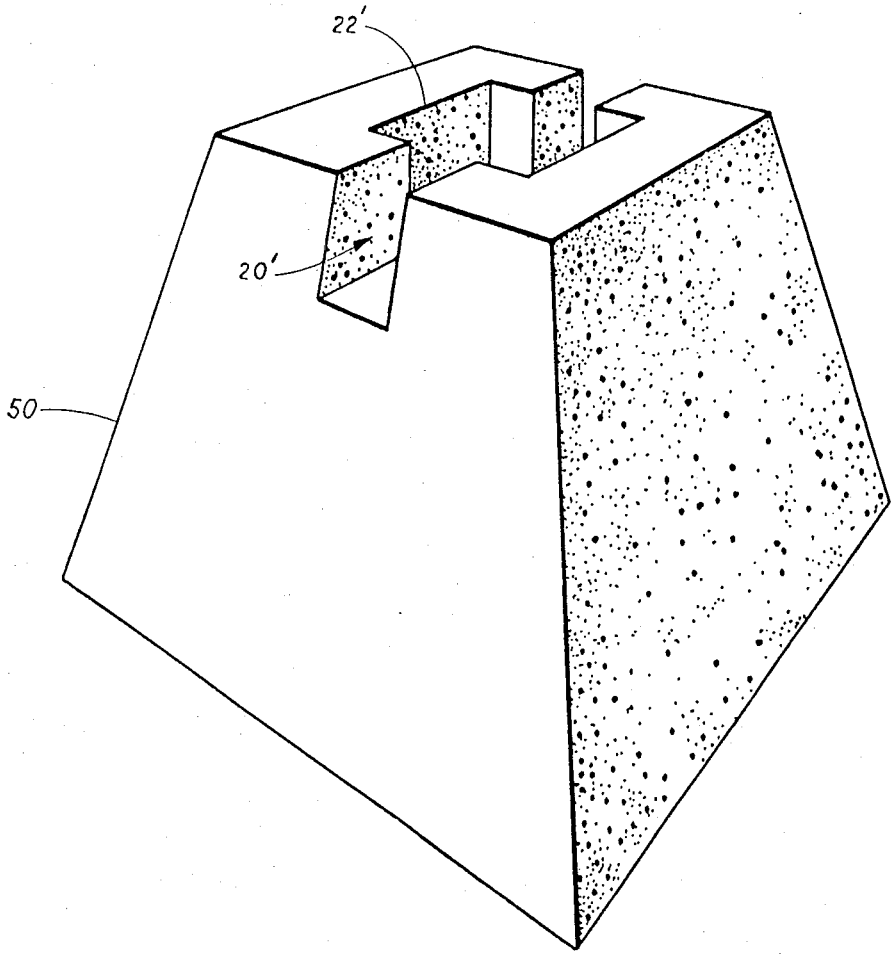
FIG. 13 is a perspective view showing a further embodiment of the invention.
Figure 14:
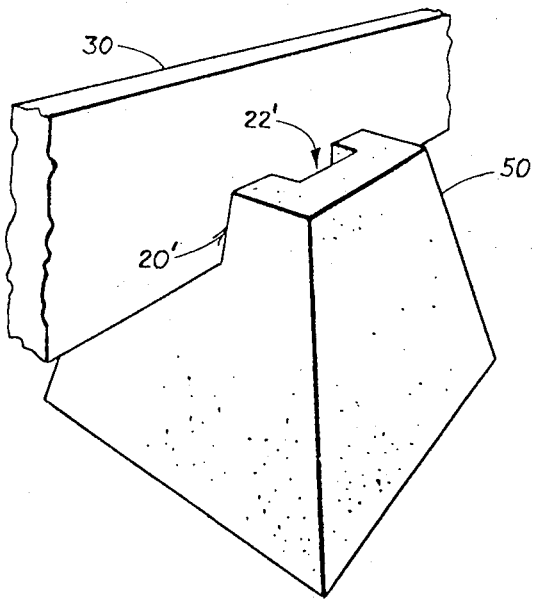
FIGS. 14 and 15 various applications of this latter embodiment with building elements.
Figure 15:
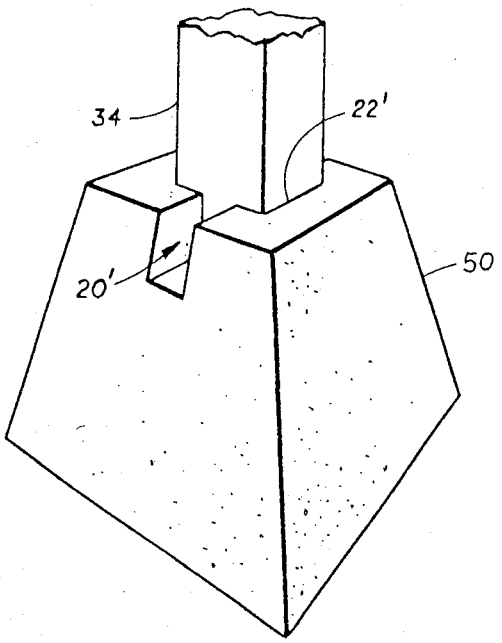

With reference to FIGS. 13, 14 and 15, the concept of the invention utilizing side recesses or openings 20' for receiving floor beams 30 and the central socket 22' for receiving vertical pillars 34 can be applied to a concrete block structure 40 by molding such openings and socket in the top of the block. With reference to FIGS. 14 and 15, this structure is similar in use to the construction device 14 of FIG. 1 to the extent that it can receive a floor beam 30 thereacross in one direction, FIG. 14, or as shown in FIG. 15 a vertical pillar 34, and if desired two side beams abutted against the pillar.

According to the present invention, a construction device is provided which conveniently provides lateral anchoring of a building element to a base. The embodiment of FIGS. 1 and 2 further provides secured attachment, by means of the fastening holes 24 and 28 of a building element to a base. The device of FIG. 1 can be inexpensively molded from plastic or stamped from metal and is simplified in its use and construction. The device of FIG. 13 can also be inexpensively poured from concrete with suitably shaped forms. The invention although embodied in a single device allows a variety of combinations and connections for building elements. The dimensions may vary and be selective to provide desired fittings of conventional building elements.

It is to be understood that the forms of our invention herein shown and described are to be taken as preferred examples of the same and that other changes in the shape, size and arrangement of parts may be resorted to without departing from the spirit of our invention or the scope of the subjoined claims.

Having thus described our invention, We claim:

1. A construction device for anchoring or connecting construction elements to a base comprising:
   - a body member having upper and lower ends and defining sides,
   - said lower end serving as a support of the member on a base,
   - and recess means in the upper end of said body member forming an anchor seat for a construction element,
   - said recess means comprising a pair of recesses extending at right angles to each other and fully from respective sides of said body member to the other whereby one or more construction elements can be laid therein in edge relation,
   - said recess means also including a rectangular socket disposed in a central portion of said body member and arranged to receive the bottom end of an upright construction element in support engagement,
   - said defining sides comprising a plurality of connected wall portions leading in a zig zag pattern forming said full width recesses and said rectangular central socket.

2. The construction device of claim 1 wherein said zig zag pattern is formed by integrated right angle inner and outer panels, at least some of said outer panels having a depending projection at the outer end thereof arranged to frictionally fit on a support block.

3. The construction device of claim 1 wherein said lower end of said body member comprises a flat wall, and including aperture means in said wall for securing said device to a base.

4. The construction device of claim 3 including depending foot members integral with said flat bottom wall for seated engagement on a base, at least some of said foot members having a central bore arranged to receive fastening elements extending down through said bottom wall and through said bore into a base.

* * * * *

UNITED STATES PATENT AND TRADEMARK OFFICE

CERTIFICATE OF CORRECTION

PATENT NO. : 4,724,642

DATED : February 16, 1988

INVENTOR(S) : PAUL HOFFMAN AND SAM H. BRIGHT

Figure 16:
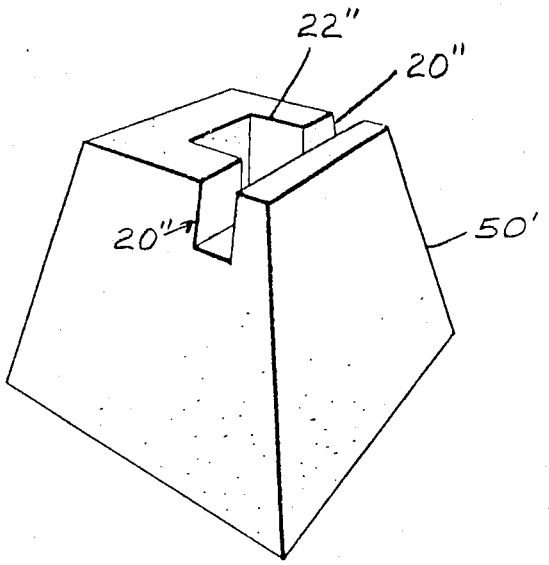
Figure 17:
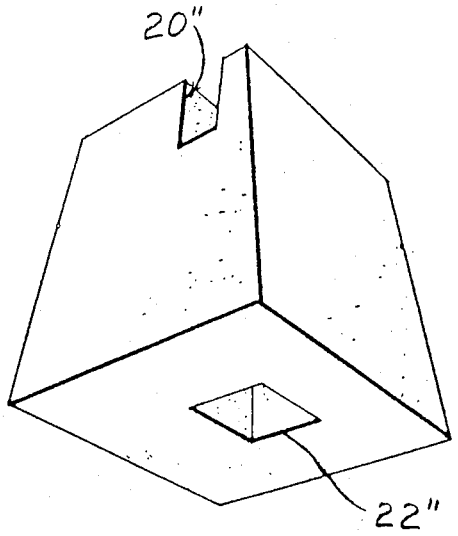

It is certified that error appears in the above-identified patent and that said Letters Patent is hereby corrected as shown below:

Figures 16 and 17 are cancelled from the disclosure.

Signed and Sealed this

Twentieth Day of September, 1988

*Attest:*

*Attesting Officer*

DONALD J. QUIGG

*Commissioner of Patents and Trademarks*